United States Patent [19]

Morton et al.

[11] Patent Number: 4,564,746

[45] Date of Patent: Jan. 14, 1986

[54] STEAM HUMIDIFIER CABINET CONSTRUCTION

[75] Inventors: Bernard W. Morton; Bruce K. Olseth, both of Minnetonka, Minn.

[73] Assignee: DRI STEEM Humidifier Company, Hopkins, Minn.

[21] Appl. No.: 629,587

[22] Filed: Jul. 11, 1984

[51] Int. Cl.[4] ..... F24F 6/18

[52] U.S. Cl. ..... 219/276; 165/78; 261/142; 219/362; 219/271

[58] Field of Search ..... 219/271, 272, 273, 274, 219/275, 276, 362; 126/113; 236/44 R; 261/142, DIG. 15, DIG. 76; 165/78

[56] References Cited

U.S. PATENT DOCUMENTS

| | | | |
|---|---|---|---|
| 2,115,567 | 4/1938 | Anderson | 165/78 |
| 2,623,735 | 12/1952 | Schofield | 165/78 |
| 2,804,870 | 9/1957 | Chelini | 219/271 |
| 2,810,381 | 10/1957 | Knight | 261/142 |
| 2,883,511 | 4/1959 | Gooldy | 219/272 |
| 2,888,006 | 5/1959 | Martin | 219/271 |
| 3,096,817 | 7/1963 | McKenna | 219/273 |
| 3,219,796 | 11/1965 | Graf | 219/273 |
| 3,642,201 | 2/1972 | Potchen | 261/DIG. 76 |
| 4,139,762 | 2/1979 | Pohrer | 219/271 |
| 4,239,956 | 12/1980 | Morton | 219/272 |

FOREIGN PATENT DOCUMENTS

| | | | |
|---|---|---|---|
| 1009604 | 11/1965 | United Kingdom | 261/142 |

OTHER PUBLICATIONS

Brochure entitled: "Humidiflo Evaporative Humidifiers," Form No. HEH-R1-0883.

*Primary Examiner*—M. H. Paschall
*Assistant Examiner*—Teresa J. Walberg
*Attorney, Agent, or Firm*—Kinney & Lange

[57] ABSTRACT

A steam humidifier cabinet provides a small cabinet which can be used in room installations and which provides a heated evaporative chamber for forming steam, and a fan for receiving the steam being generated and dispersing it through a cabinet passageway into the room. The evaporative chamber used for generating the steam is enclosed to prevent any leakage, or damage, and is accessible easily for cleaning or other servicing because it mounts on tracks which permit it to be slid out of the cabinet enclosure. Additionally, the heating element used for generating steam is attached to a cover and the cover is supportable out of the way on supports provided on the cabinet.

5 Claims, 6 Drawing Figures

STEAM HUMIDIFIER CABINET CONSTRUCTION

BACKGROUND OF THE INVENTION

1. Field of the Invention

The present invention relates to a cabinet type steam humidifier which provides easy access to the components, and provides efficient dispersion of steam into a room.

2. Description of the Prior Art

Various steam humidifiers have been used in the prior art. The assignee of the present applicant has made and sold devices which have heating units and fans, with steam dispersion tubes that disperse the air into existing duct work. Additionally, evaporative humidifiers have been utilized which mount along side duct work and use a fan for blowing air across a heating unit and outer chamber into duct work. There also are existing evaporators and humdifiers which use rotating wheels through which air is drawn and then discharged either directly into a room or into duct work.

It has long been known that steam humidification, however, is desirable because of the rapid dispersion of the water vapor into the air. The present device provides a unit that permits dispersion from a small cabinet so that rooms which do not have forced air ventilation or heating can have the benefits of steam humidification.

SUMMARY OF THE INVENTION

The present invention relates to a cabinet construction for a steam type humidifier that can be used for humidifying rooms with no external air duct work. The cabinet has a first space for a self contained fan and a steam generator or evaporative chamber. The evaporative chamber is connected to steam dispersion tubes in a seamed space defining an air flow path. The dispersion tubes have nozzles facing in a first direction away from an air outlet but toward a fan discharge opening so that the steam from the nozzles must reverse direction to be dispersed in the air for maximum effect prior to discharge from the grill work.

Additionally, the steam cabinet or evaporative chamber is self contained with the steam generating heaters, water level controls and all other components mounted on the cover. The cover is held on the main chamber with four draw latches and also the main chamber is slideably mounted on the cabinet so that the evaporative chamber can be slid out of the cabinet for service, and the cover removed. Convenient retainer flanges for the cover are mounted in the cabinet on a divider wall above the evaporative chamber which will space the heater and other control components above the chamber to permit the evaporative chamber to be cleaned easily, and/or the heaters and controls to be serviced.

No auxiliary air is necessary, and the fan will permit dispersion of the steam adequately for humidifying average size rooms from a small cabinet.

DETAILED DESCRIPTION OF THE PREFERRED EMBODIMENT

Figure 1:
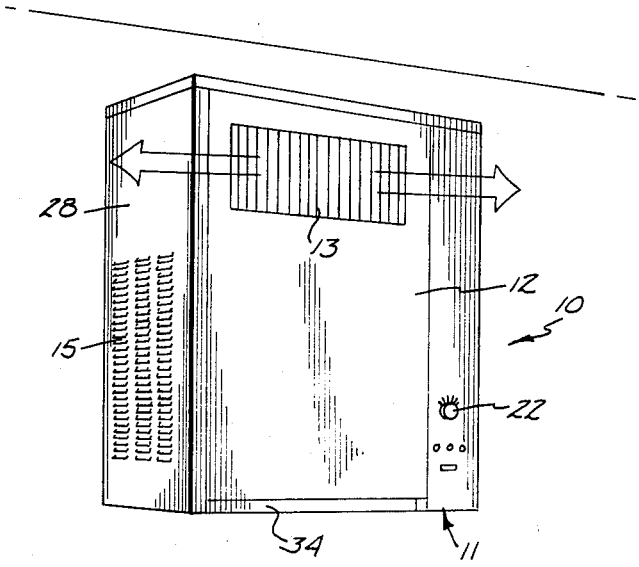
FIG. 1 is a perspective view of a cabinet type humdifier made according to the present invention.

A wall mount cabinet type humidifier indicated generally at 10 has an outer housing or cabinet 11 of suitable design. The cabinet 11 comprises a frame and has a front panel member 12 which is removable. The front panel has an air outlet louver 13 that receives air from an air discharge opening indicated at 14 in the interior the cabinet (see FIGS. 2 and 3). The louver 13 disperses air into a room. The air outlet opening 14 discharges air into which steam or water vapor has been injected by steam nozzles as will be explained.

An air opening 15 is positioned on one end of the cabinet or housing, and the air inlet opens to the intake side of a fan 20 that is mounted in the lower portion of the cabinet or housing. The fan is driven by an electric motor 21 that is powered through suitable controls 22 in a normal manner. These controls can include a humidistat to set the relative humidity level of the room, as well as suitable on/off switches and lights that indicate the operation of various components.

The fan 20 is located in a lower compartment indicated at 25 of the cabinet, and the lower compartment is defined by a lower wall 26 of the housing, the removable panel 12 and a parallel rear wall 27, as well as end walls 28 at opposite ends of the housing. The upper side of the lower compartment 25 is defined by a divider wall 30 that extends between the cover and rear wall from end to end within the cabinet.

Figure 3:
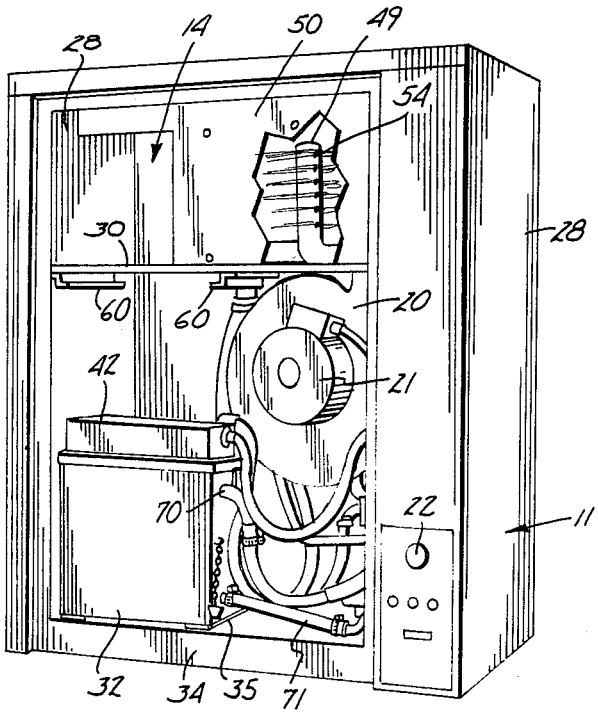
FIG. 3 is a perspective view from the opposite front corner from FIG. 2 showing the components in position within the outer cabinet.

The evaporative chamber assembly for formation of steam is indicated generally at 32, and comprises a chamber or tank 33 that is slideably mounted on suitable tracks 34 mounted on the lower floor of the compartment 25. It should be noted that the lower portion of compartment 25 is formed as a drip chamber in that the removable panel 12 terminates a short distance above the bottom wall 26, as shown in FIG. 3 to form a lip 34. This lip 34 is raised sufficiently so that any condensation or water collecting will be trapped in the cabinet, and a suitable drain fitting (not shown) can lead from this deep tray to a drain.

Figure 5:
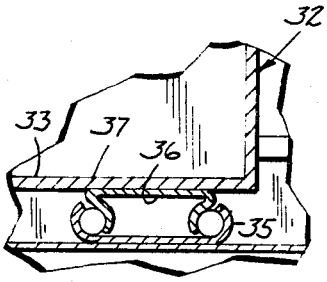
FIG. 5 is a fragmentary sectional view of a typical supporting track for slideably supporting the evaporative compartment.

The bottom wall 37 of the chamber or tank 33 has suitable track followers 36 as indicated in FIG. 5 therein. The bottom wall 37 of the evaporative chamber or tank is joined to upright walls 38 which form a generally square cross section chamber that extends uprightly, and which has a cover assembly 40 at the upper end thereof. The cover assembly 40 has a flange around its outer edge, and is sealed with a suitable gasket with respect to the upper edges of the side walls 38 when in position. The cover 40 includes all of the electrical controls that are necessary, including immersion type heaters 41 which are fastened to the cover 40 in a suitable manner. The cover assembly has a housing 42 on its upper side to enclose the heater connections and other control components. A multiple level indicator control 44 of a conventional design is mounted on the cover and has connections inside the upper housing on the cover. When the cover is lifted from the chamber or tank 33, the entire heater and control assembly also is lifted. The cover is held in place on the tank or chamber with suitable over center draw latches indicated at 45 to tightly seal the cover during use.

The water level in the tank or chamber 33 is controlled by the level control 44, so that there is a space above the water and underneath the cover, and as the heaters are turned on to form steam (by evaporating the water) the steam is discharged through a discharge connection indicated at 46 (see FIG. 2) into a flexible tube 47 and through the tube 47 to a dispersion tube assembly 48. The dispersion tube assembly includes a pair of upright tubes 49 that are laterally spaced and within a chamber formed between the rear wall 27 and an upright divider wall 50 which is spaced from the cover 12 of the cabinet. The wall 50 forms an interior duct for discharge of air and forms the air outlet 14 adjacent the opposite end of the cabinet from a fan discharge opening 15 formed through the divider wall 30. The tubes 49 have suitable nozzles that face in the direction of fan discharge opening at 51 which leads from the output side to the fan 20 up into the upper chamber defined by the rear wall 27, and the divider wall 50. As shown in FIG. 3, the tubes 49 may have nozzles 54 thereon, which are spaced vertically and which discharge the steam or water vapor toward the fan outlet.

When the fan is running, of course, air will be flowing in the direction toward the outlet opening 14 and through the louver 13 into the room. There is a space between louver 13 and wall 50 through which discharge air flows.

Figure 2:
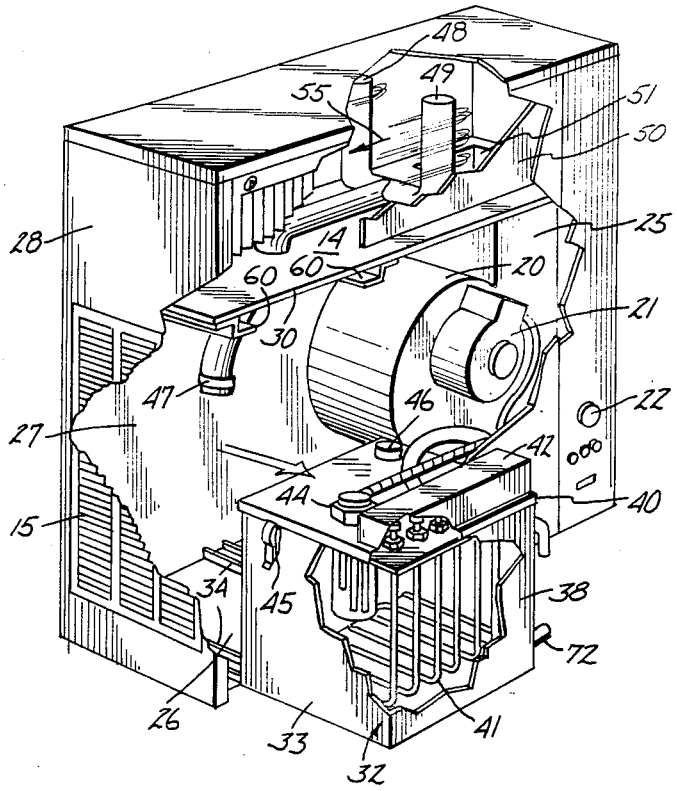
FIG. 2 is an enlarged perspective view of the device of the present invention with parts of an outer cabinet broken away to show the interior thereof.

It should be noted that the flow of the steam or water vapor has to change direction. That is the steam from the nozzles is directed toward the far end wall of the cabinet as shown in FIG. 2, and the air is going in the opposite direction toward outlet 14, as indicated by the arrow 55.

Figure 6:
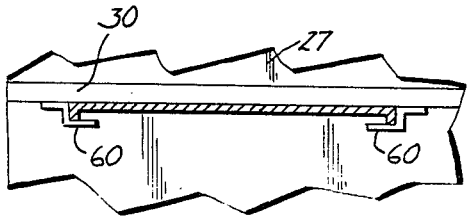
FIG. 6 is a sectional view showing the cover for the evaporative compartment in a position wherein it is supported for service.
Figure 4:
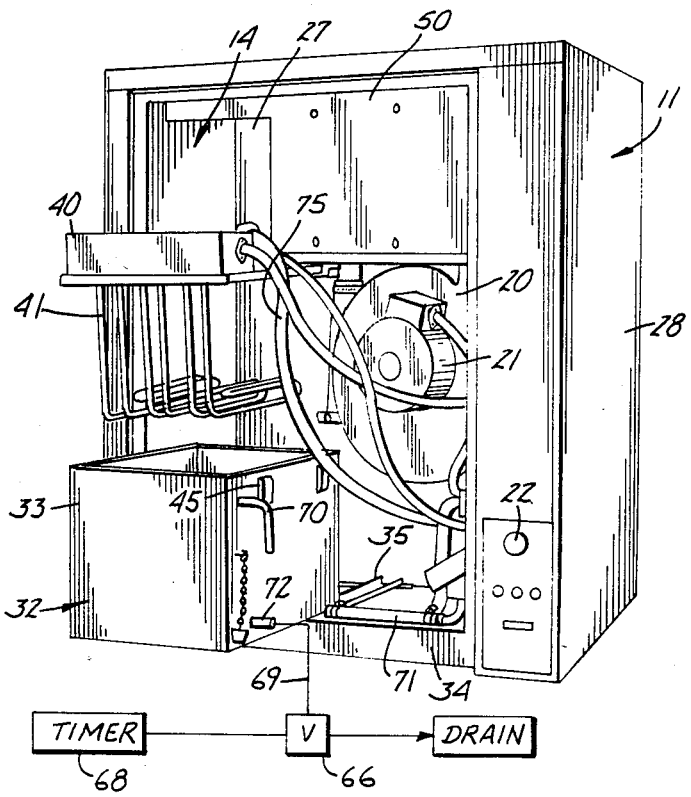
FIG. 4 is a perspective view taken from the same position as FIG. 3 showing an evaporative compartment and cover positioned for maintenence and cleaning of the compartment.

A further feature of the present device is that the divider wall 30 has spaced apart support flanges 60 mounted on the lower side thereof. The flanges are of sufficient length to hold the cover assembly 40 immediately below the divider wall above the tank or evaporative chamber container 33 when servicing the evaporative chamber. As shown in FIG. 4, slipping the cover 40 into these flanges provides a support for the heater, level sensor and controls which is above the evaporative chamber. With the evaporative chamber 33 pulled out from its working position and the cover slid rearwardly in the flanges until the protrusion for the level control strikes the front edge of the divider wall 30, the cover 40 will be retracted sufficiently to permit one to have access to the interior of the evaporative chamber for cleaning and removing scale and the like. Additionally any servicing of the heaters is easily done with the cover 40 supported in its position shown in FIG. 4. The cover assembly is shown in section FIG. 6 in position in the flanges.

A further feature of the present device is shown in FIG. 4 where a remote control timer operated valve 66 can be provided in a drain line 69 leading from a drain fitting to the evaporative chamber, and when operated by a timer 68, the valve will open to discharge the water from the tank or evaporative chamber 33 flush through the water.

When the compartment is to be serviced, the drain hose indicated at 71 is disconnected from the drain fitting, and an overflow hose from the overflow fitting 70 is also disconnected. The water inlet hose indicated at 75 attaches to the cover assembly, through the valve housed in the level control, and this can be left slack enough to remain connected when the tank or evaporative chamber is moved out of the lower chamber. The draw latches 45 are released and the cover is lifted up to be supported in the flanges 60. The flexible steam hose 47 is also disconnected before the evaporative chamber is slid out from the lower compartment. The electrical wires may be left slack enough so no electrical disconnect is required for serving the unit as shown.

In this way the evaporative chamber and its operating components can easily be serviced. When servicing is completed, the hoses are reconnected.

What is claimed is:

1. A cabinet mounted steam humidifier comprising an outer housing forming an enclosed cabinet of size to be mounted on a wall of a room and having first and second end walls and a side wall facing into such room comprising:

first wall means for dividing said cabinet into an upper and a lower chamber;

an air inlet in the first end of said housing leading to said lower chamber and open to a room;

an air outlet defined in upper chamber open to a room and defined in the side wall of the housing;

a fan mounted in said lower chamber and having an inlet drawing air from the air inlet, and a fan discharge opening to said upper chamber at a position at the second end of the housing;

second walls forming an enclosed evaporative chamber in which steam is formed including a heater unit forming steam from water, said evaporative chamber being mounted in said lower chamber;

a divider wall in the upper chamber alongside the fan discharge opening and spaced from the first side wall and located at the second end of the housing to form a duct passage in the upper chamber extending toward the first end of the housing; and steam dispersion tubes mounted in said upper chamber within the duct formed by the divider wall and connected to said evaporative chamber for dispersing water vapor adjacent the discharge opening from said fan in an opposite direction from normal airflow from the fan whereby air from the fan flows in an airflow path past said steam dispersion tubes in the duct, toward the second end and causes the water vapor to change direction of flow and pass from the fan discharge opening to the air outlet of said housing, and the evaporative chamber and fan being isolated from the airflow path by said first wall means.

2. The apparatus of claim 1 wherein said first wall is substantially horizontal, and the discharge opening from the fan directs air vertically near the second end of the cabinet, the steam dispersion tubes having nozzles that direct water vapor to the region above the fan discharge opening.

3. A cabinet mounted steam humidifier comprising an outer housing forming an enclosed cabinet;

first wall means for dividing said cabinet into an upper and a lower chamber;

an air inlet in said lower chamber;

an air outlet defined in upper chamber;

a fan mounted in said lower chamber and having a discharge opening to said upper chamber at a position remote from said air outlet;

second walls forming an enclosed evaporative chamber in which steam is formed including a heater unit forming steam from water, said evaporative chamber being mounted in said lower chamber; and steam dispersion tubes mounted in said upper chamber and connected to said evaporative chamber for dispersing water vapor adjacent the discharge opening from said fan in an opposite direction from normal airflow, whereby air from the fan flows in an airflow path past said steam dispersion tubes and causes the water vapor to change direction of flow and pass to the air outlet of said outer housing, and the evaporative chamber and fan being isolated from the airflow path by said first wall means;

said evaporative chamber comprising a second housing having an open top defining upper edges, and a cover, said heater being mounted on said cover, and water level control means also mounted on said cover, a pair of flanges for supporting said cover on the first wall means when the cover is removed from the evaporative chamber, said first wall means being sufficiently spaced from the evaporative chamber so said heater clears the upper edges of the evaporative chamber when supported on said flanges to permit access to said evaporative chamber.

4. The apparatus as specified in claim 3 where said evaporative chamber is slideably mounted on said first mentioned housing, and slideable to a position where it is substantially exterior to the lower chamber formed in said first mentioned housing.

5. The apparatus of claim 4 wherein the cabinet has side walls, one of the side walls comprising a removable cover providing access to the entire upper and lower compartments.

* * * * *